US012753130B2

(12) United States Patent
Ozalp

(10) Patent No.: US 12,753,130 B2
(45) Date of Patent: Oct. 6, 2026

(54) CHEMICAL COMPOSITION FOR ELECTRONICALLY ACTIVATED CHEMICAL ROCK BREAKING SYSTEM

(71) Applicant: AMITY HAM PETROL VE DOGAL GAZ ARAMA VE URETIM ANONIM SIRKETI, Ankara (TR)

(72) Inventor: Yusuf Vasfi Ozalp, Ankara (TR)

(73) Assignee: TOCK KAYA KIRMA TEKNOLOJILERI LIMITED SIRKETI, Ankara (TR)

( * ) Notice: Subject to any disclaimer, the term of this patent is extended or adjusted under 35 U.S.C. 154(b) by 9 days.

(21) Appl. No.: 19/109,263

(22) PCT Filed: Sep. 13, 2022

(86) PCT No.: PCT/TR2022/050981
§ 371 (c)(1),
(2) Date: Mar. 6, 2025

(87) PCT Pub. No.: WO2024/054169
PCT Pub. Date: Mar. 14, 2024

(65) Prior Publication Data

US 2026/0098000 A1 Apr. 9, 2026

(30) Foreign Application Priority Data

Sep. 6, 2022 (TR) ..... 2022/013875

(51) Int. Cl.
*C06B 29/08* (2006.01)

(52) U.S. Cl.
CPC ..... *C06B 29/08* (2013.01)

(58) Field of Classification Search
None
See application file for complete search history.

(56) References Cited

U.S. PATENT DOCUMENTS

| | | | | |
|---|---|---|---|---|
| 3,135,634 | A * | 6/1964 | Moore | C06B 31/02 149/19.91 |
| 2003/0234103 | A1* | 12/2003 | Lee | C09K 8/487 507/224 |
| 2021/0024814 | A1* | 1/2021 | Schipper | C09K 8/035 |

FOREIGN PATENT DOCUMENTS

| | | | |
|---|---|---|---|
| CN | 108752148 | A | 11/2018 |
| GB | 2296270 | A | 6/1996 |
| JP | 2016166100 | A | 9/2016 |

OTHER PUBLICATIONS

International Search Report and Written Opinion for International Application No. PCT/TR2022/050981, mailing date of Aug. 14, 2023.

* cited by examiner

*Primary Examiner* — Aileen B Felton
(74) *Attorney, Agent, or Firm* — FRESH IP PLC; Clifford D. Hyra; Aubrey Y. Chen

(57) ABSTRACT

Disclosed is a chemical composition for electronically activated chemical rock breaking system, and it includes potassium chlorate with ratio of 20-55% by weight of the chemical composition, sodium perborate and/or Tetra acetyl ethylene diamine (TAED) or any combination of them with ratio of 10-24% by weight of the chemical composition, at least one fruit and/or vegetable powder selected from the group consisting of carob powder, dried grape powder, dried currant powder, dried date powder, dried coconut fruit powder, dried pumpkin powder, dried sugarcane, sugar beet powder, dried tamarind powder and dried fig powder with ratio of 9-28% by weight of the chemical composition, at least one powder selected from the group consisting of olive pulp powder, nut shell powder, coconut shell powder, pumpkin seed shell powder, sunflower seed shell powder with ratio of 5-20% by weight of the chemical composition.

4 Claims, No Drawings

CHEMICAL COMPOSITION FOR ELECTRONICALLY ACTIVATED CHEMICAL ROCK BREAKING SYSTEM

This application is a National Phase entry of International Application No. PCT/TR2022/050981 under § 371 and claim the benefit of Türkiye Patent Application No. 2022/013875 filed on Sep. 6, 2022, which is hereby incorporated by reference in its entirety.

FIELD OF THE DISCLOSURE

This disclosure relates to a novel chemical composition for electronically activated chemical rock breaking system.

BACKGROUND

This disclosure relates to a novel chemical composition for the complete system defined as "ELECTRONICALLY ACTIVATED CHEMICAL ROCK BREAKING SYSTEM", to break rock and hard formations, in the safest way avoiding any risk encountered by breaking products like; explosives, pyrotechnical products, and also in the quickest and cheapest way when compared to products like; chemical, mechanical and/or hydraulic rock breaking machinery and equipment.

One of the main targets of the disclosure is to have a complete system which will be totally away from the definition of explosives and pyrotechnical products as well as to be away from those regulations and documentation such existing products require.

The chemical composition of the present disclosure is designed and developed to be used for the fields of construction, mining, manufacturing industry where there is a need of breaking all sorts of hard formations and structures.

Today, there are several products and techniques for breaking rock. These are basically; Chemical, Hydraulic, Mechanical or Explosive. Among these, the major ones can be given as follows;

1. Expanding Grouts
   These products are generally mixture of oxides and are composition of inorganic and organic compounds. In order to use them, they have to be mixed with water at certain proportion; slurry is obtained and then poured into the drilled holes.
   The pressure obtained is relatively low, they can create only cracks, time to break takes long time (10-20 hours), requires too many holes to crack.
2. Pyrotechnical Rock Breaking Products
   These rock breaking products are generally mixtures of some compounds like; nitrate based chemicals and/or peroxides. These mixtures are filled in cartridges. Almost all of them are ignited with fuses, detonators or propellants. Besides, due to the chemicals and ignition components, they are under UN No. 0432 and Class 1.4S or 1.4G. These products generally require special certification and permission for import, transport, usage and storage. Meanwhile, permissions from local authorities are also required in many countries.
3. Hydraulic Rock Splitters
   Basically, these are mechanical products. The product generates its breaking action with the hydraulic pressure exerted by the steel elements placed into the holes.

Generally, mechanical failures cause the system to stop and face delays in operations. Requires many holes to break and accessories in the system lead to slow mobility.
4. Hydraulic Rock Breakers
   These are very common mechanical hammers mostly used coupled to excavators. They get their hydraulic power from the units embedded in the excavators. While creating a continuous noise for hitting the rock, their breaking capacities are relatively low.
5. Hand-held Rock Breakers
   These machines are almost the oldest mechanical tools for breaking rock. Generally, they are used for very small jobs, each tool requires an operator. Besides, their capacities are very low compared to all other products and equipment.
6. Explosives
   Among all products mentioned, explosives are the most risky products. Today, use of any sort of explosives is forbidden within the limits of rural areas. Besides, all related actions and operations are subject to strict permission and certifications. Meanwhile, the pressure they create on the atmosphere lead to very high detonation velocity and impact pressure.

Each one above or in combined way of using, the target has always been same; breaking rock according to the demands of the sectors like, construction and mining.

As a prior art document, EP 2651855 B1 entitled "ROCK AND CONCRETE BREAKING (DEMOLITION-FRACTURING-SPLITTING) SYSTEM" discloses a chemical mixture (34), comprising potassium chlorate with ratio of 30-70% by weight of mixture, ammonium oxalate, with ratio of 15-35%, by weight of mixture, sugar or lactose or starch or any combination of them with ratio of 15-20% by weight of mixture, boron oxide (boroxide) ($B_2O_3$) with ratio of 5-10% by weight of mixture, borax decahydrate ($Na_2B_4O_7 \cdot 10H_2O$) with ratio of 3-5% by weight of mixture. We would like to draw attention to the fact that the inventor of the present disclosure, Mr. Yusuf Vasfi Ozalp is one of the two inventors of this aforementioned EP 2651855 B1 patent. When the ingredients of the previous chemical mixture of EP 2651855 B1 and the chemical composition of the present disclosure is compared, it will be easily understood that with the present disclosure, a totally new chemical composition for electronically activated chemical rock breaking system is found.

US patent publication No. U.S. Pat. No. 4,565,579A entitled "Nonexplosive chemical composition for gently breaking rock or concrete mass" discloses a nonexplosive chemical composition for gently and noiselessly breaking a rock or concrete mass. Said composition comprises a principal component which is prepared by calcining a starting mixture comprising 100 parts by weight of quick lime and 1-20 parts by weight of calcium fluoride.

As another prior art document, British patent publication No. GB2296270A entitled "Non-explosive breaking composition" discloses a non-explosive breaking composition for breaking rock or concrete. Said composition includes 100 parts by weight of a thermit mixture which consists of 15-30 wt % of aluminum powder, a dust scattering preventing agent and an antioxidant, and 70-80 wt % of copper oxide; and 80-120 parts by weight of a cracked gas generator.

The basic aims of the chemical composition of this disclosure—by introducing a technology for construction and mining sectors and to all others that requires rock breaking—can be defined as follows:

a) That has to be away from all types of explosives and such components, products, etc. and away from those that are accepted as explosives.
b) That has to be as simple as possible to learn and apply.
c) That has to be as universal as possible so that; it can be produced/manufactured at almost all regions of the world.
d) That has to be as efficient, productive as possible so that; it should let the end users to gain time and money.
e) That has to be as safe as possible so that; there should be no shock waves, no fly rock and insignificant level of ground vibrations. Meanwhile, it must be possible to transport the system by all means of transport (air-road-sea-rail).
f) That has to be as compact as possible so that, all system can be placed in a box of sizes max. 50×60×50 cm (=0.15 $m^3$).
g) That has to be as environmentally friendly as possible.
h) That has to be as economic as possible to drop the excavation costs.

SUMMARY

This disclosure relates to a chemical composition for electronically activated chemical rock breaking system, and it comprises potassium chlorate with ratio of 20-55% by weight of the chemical composition, sodium perborate or Tetra acetyl ethylene diamine (TAED) or any combination of them with ratio of 10-24% by weight of the chemical composition, at least one fruit and/or vegetable powder selected from the group consisting of carob powder, dried grape powder, dried currant powder, dried date powder, dried coconut fruit powder, dried pumpkin powder, dried sugarcane, sugar beet powder, dried tamarind powder and dried fig powder with ratio of 9-28% by weight of the chemical composition, at least one powder selected from the group consisting of olive pulp powder, nut shell powder, coconut shell powder, pumpkin seed shell powder, sunflower seed shell powder with ratio of 5-20% by weight of the chemical composition.

DETAILED DESCRIPTION

This disclosure relates to a chemical composition for electronically activated chemical rock breaking system, and it comprises potassium chlorate with ratio of 20-55% by weight of the chemical composition, sodium perborate or Tetra acetyl ethylene diamine (TAED) or any combination of them with ratio of 10-24% by weight of the chemical composition, at least one fruit and/or vegetable powder selected from the group consisting of carob powder, dried grape powder, dried currant powder, dried date powder, dried coconut fruit powder, dried pumpkin powder, dried sugarcane, sugar beet powder, dried tamarind powder and dried fig powder with ratio of 9-28% by weight of the chemical composition, at least one powder selected from the group consisting of olive pulp powder, nut shell powder, coconut shell powder, pumpkin seed shell powder, sunflower seed shell powder with ratio of 5-20% by weight of the chemical composition.

According to a preferred embodiment of the disclosure, said sodium perborate in the chemical composition is either monohydrate or tetrahydrate. Also, said olive pulp powder in the chemical composition is grinded dry powder of green and/or black olive pulp. In addition, said chemical composition may further comprise non-explosive solid or liquid chemicals or some adhesives/glue or binders.

Chemical composition according to the present disclosure is the result of mechanical mixing of dry powder of all ingredients taking part in the chemical composition. Before, during and after the preparation, there is not any reaction or a specific process. Necessary Explanation: The chemical composition is obtained by mixing all powder ingredients with a suitable mixer. In order to get the required final homogenous mixture, we recommend using the mixer designed and manufactured by us. This mixer is rotating at 2 axes at a certain revolution per minute (rpm) and can be operated manually. It is tested several times and has specific fixed mixing drum volume vs. fixed amount of mixture at a specified time.

This dry mixture is filled in the modules which are produced according to required sizes considering given specifications.

Necessary Explanation: For module filling, we also recommend a filling procedure and system that will lead to an efficient and safe operation.

The basic chemicals and ingredients that make up the chemical composition are;

Potassium Chlorate

Sodium Perborate (monohydrate or tetrahydrate)

Carob Powder (Ceratonia siliqua powder)

Olive Pulp Powder (pirina)

Besides, the chemical composition may further comprise any one or more of the following:

TAED (Tetra acetyl ethylene diamine)

Nut shell powder, coconut shell powder, pumpkin seed shell powder, sunflower seed shell powder (and similar shell powders)

Dried grape powder, dried currant powder, dried date powder, dried coconut fruit powder, dried pumpkin powder, dried sugarcane and sugar beet powder, dried tamarind powder, dried fig powder (and similar dried fruit or vegetable powders).

The chemical composition ratios by weight (formulation) to prepare the chemical composition of the present disclosure can be given on Table 1.

TABLE 1

Ratios of Chemicals/Ingredients of the mixture, by weight.

| CHEMICAL / INGREDIENT | % RATIO (by weight) |
|---|---|
| Potassium Chlorate- $KClO_3$ | 20-55% |
| Sodium Perborate/TAED (Tetra acetyl ethylene diamine- $C_{10}H_{16}N_2O_4$) | 10-24% |
| Carob Powder/Grape/Currant/Date powder/ Coconut fruit powder/Pumpkin powder/ Sugarcane-Sugar beet powder/Tamarind powder/ Fig powder * | 9-28% |
| Olive Pulp Powder/Nut shell powder/ Coconut shell powder, Pumpkin seed shell powder, Sunflower seed shell powder ** | 5-20% |

There are selected combinations of the given chemicals and ingredients from which we can arrive to different energy levels that lead the invented product to break different types of rock. Below, one can find some of these combinations selected (ratios by weight) to lead to a highest level of breaking:

(*) These powders are from their original dried fruit or vegetable.

(**) These powders are from their original dried fruit or vegetable.

Some embodiments of the disclosure regarding the contents of the chemical composition are given below.

| Mixture Combinations of the Chemical Composition of The Present Disclosure | | |
|---|---|---|
| Mixture -1 | | |
| Potassium Chlorate - $KClO_3$ | 45% | |
| Sodium Perborate Tetrahydrate - $NaBO_3 \cdot 4H_2O$ | 20% | |
| Carob Powder | 25% | |
| Olive Pulp Powder | | 10% |
| TOTAL: | 100% | |
| Energy output; Average: 525-540 cal/gr. | | |
| Mixture -2 | | |
| Potassium Chlorate - $KClO_3$ | 55% | |
| Sodium Perborate Tetrahydrate - $NaBO_3 \cdot 4H_2O$ | 16% | |
| Carob Powder | 21% | |
| Olive Pulp Powder | | 8% |
| TOTAL: | 100% | |
| Energy output; Average: 630-650 cal/gr. | | |
| Mixture -3 | | |
| Potassium Chlorate - $KClO_3$ | 39% | |
| Sodium Perborate Tetrahydrate - $NaBO_3 \cdot 4H_2O$ | 24% | |
| Carob Powder | 28% | |
| Olive Pulp Powder | | 9% |
| TOTAL: | 100% | |
| Energy output; Average: 540-560 cal/gr. | | |
| Mixture - 4 | | |
| Potassium Chlorate - $KClO_3$ | 44% | |
| Sodium Perborate Tetrahydrate - $NaBO_3 \cdot 4H_2O$ | 22% | |
| Carob Powder | 27% | |
| Olive Pulp Powder | | 7% |
| TOTAL: | 100% | |
| Energy output; Average: 520-550 cal/gr. | | |
| Mixture - 5 | | |
| Potassium Chlorate - $KClO_3$ | 55% | |
| Sodium Perborate Tetrahydrate - $NaBO_3 \cdot 4H_2O$ | 18% | |
| Carob Powder | 19% | |
| Olive Pulp Powder | | 8% |
| TOTAL: | 100% | |
| Mixture - 6 | | |
| Potassium Chlorate - $KClO_3$ | 34% | |
| Sodium Perborate Tetrahydrate - $NaBO_3 \cdot 4H_2O$ | 23% | |
| Carob Powder | 26% | |
| Olive Pulp Powder | | 17% |
| TOTAL: | 100% | |
| Mixture - 7 | | |
| Potassium Chlorate - $KClO_3$ | 38% | |
| Sodium Perborate Tetrahydrate - $NaBO_3 \cdot 4H_2O$ | 24% | |
| Carob Powder | 27% | |
| Olive Pulp Powder | | 11% |
| TOTAL: | 100% | |
| Mixture - 8 | | |
| Potassium Chlorate - $KClO_3$ | 28% | |
| Sodium Perborate Tetrahydrate - $NaBO_3 \cdot 4H_2O$ | 24% | |
| Carob Powder | 28% | |
| Olive Pulp Powder | | 20% |
| TOTAL: | 100% | |
| Mixture - 9 | | |
| Potassium Chlorate - $KClO_3$ | 50% | |
| Sodium Perborate Tetrahydrate - $NaBO_3 \cdot 4H_2O$ | 15% | |

-continued

| Mixture Combinations of the Chemical Composition of The Present Disclosure | | |
|---|---|---|
| Dried Date Powder | | 25% |
| Olive Pulp Powder | | 10% |
| TOTAL: | 100% | |
| Mixture -10 | | |
| Potassium Chlorate - $KClO_3$ | 47% | |
| Sodium Perborate Tetrahydrate - $NaBO_3 \cdot 4H_2O$ | 20% | |
| Dried sugar beet powder | | 28% |
| Olive Pulp Powder | | 5% |
| TOTAL: | 100% | |
| Mixture -11 | | |
| Potassium Chlorate - $KClO_3$ | 45% | |
| Sodium Perborate Tetrahydrate - $NaBO_3 \cdot 4H_2O$ | 23% | |
| Carob Powder | 25% | |
| Nut shell Powder | | 7% |
| TOTAL: | 100% | |
| Mixture -12 | | |
| Potassium Chlorate - $KClO_3$ | 48% | |
| Sodium Perborate Tetrahydrate - $NaBO_3 \cdot 4H_2O$ | 22% | |
| Dried Tamarind Powder | | 24% |
| Olive Pulp Powder | | 6% |
| TOTAL: | 100% | |
| Mixture -13 | | |
| Potassium Chlorate - $KClO_3$ | 50% | |
| Sodium Perborate Tetrahydrate - $NaBO_3 \cdot 4H_2O$ | 10% | |
| Carob Powder | 20% | |
| Olive Pulp Powder | | 5% |
| TAED - $C_{10}H_{16}N_2O_4$ | | 15% |
| TOTAL: | 100% | |
| Energy output; Average: 510-540 cal / gr. | | |
| Mixture -14 | | |
| Potassium Chlorate - $KClO_3$ | 40% | |
| Sodium Perborate Tetrahydrate - $NaBO_3 \cdot 4H_2O$ | 15% | |
| Carob Powder | 20% | |
| Olive Pulp Powder | | 5% |
| TAED - $C_{10}H_{16}N_2O_4$ | | 20% |
| TOTAL: | 100% | |
| Mixture -15 | | |
| Potassium Chlorate - $KClO_3$ | 45% | |
| Sodium Perborate Tetrahydrate - $NaBO_3 \cdot 4H_2O$ | 15% | |
| Carob Powder | 25% | |
| Olive Pulp Powder | | 5% |
| Pumpkin Seed Shell Powder | 10% | |
| TOTAL: | 100% | |

According to the evaluations and measurements, the energy output of the tested mixtures varies between 350-650 cal/g on average.

The chemical composition of the present disclosure is designed and developed for rock breaking in different fields of construction and mining;

Road construction
Boulder breaking
Trenching and canal opening
Tunneling and shaft sinking
Dimension stone splitting
Foundation and infrastructure excavation
Concrete and reinforced concrete breaking
Underwater excavation of rock
Blocked and clogged silo cleaning and rat hole opening
Interior breaking of rock, etc.

The application of the chemical composition according to the present disclosure for electronically activated chemical rock breaking system can be given in 4 stages with necessary steps as follows:

A—Observations and Preparations

A.1) Examine the field in terms of distance from the nearest critical place (building, road, people, etc.). Considering the level of sensitivity, prepare all necessary equipment, safety materials to be used at site.

A.2) Examine the field to set the correct burden vs. spacing. The shape of the rock to be removed must let you decide the correct way of breaking (module per hole, no's of holes per each activation, etc.).

A.3) Examine the field to set the correct hole diameter and length. Correct hole diameter and length will lead you to a complete consumption of modules, thus; correct volume of rock breaking.

A.4) Drill the holes and keep them safe (away from any stone/debris or water to go in). Depending on the site condition, holes should be vertical or at certain angels (generally in parallel with the free face).

B—Material & Equipment Preparations

B.1) Select the module size (diameter, length, amount) according to the rock data and as per your preparations in Item (A).

Notice: the basic data—rock type/hole diameter/hole length/burden/spacing—are very important to select the correct size.

B.2) Make sure that all selected modules and/or wire sets are active (use related testing device to check).

B.3) Place all modules inside the holes one by one gently always being very careful. After being sure that all is placed well and safely, hold wires out of holes keeping them along the walls of the holes to avoid any failures, wire cuts, etc.

B.4) When the module is at the bottom, start stemming by dropping ready-made small stones, then placing ceramic mud and finally complete it by pouring stemming material/just the surrounding debris and material came out from hole carefully.

B.5) When stemming is done, check the wires once more to be sure that they are active.

B.6) When all is completed, place the covers carefully and logically over the holes and over the free faces that will break away, avoiding any drop off, open sections, etc., B.7) Check the wires to avoid any failure (be sure that they are active) once more.

C—the Activation Stage

C.1) When all operations are completed; make sure that; modules are in place, stemming is done, wires are checked.

C.2) Connect the energy supply cable to the ESU.

C.3) Connect the Energy Supply Unit (ESU) to the power source (city mains or generator).

C.4) At this stage, check all wires and energy supply cable; they should be laid on the ground as a line (not in bundles or on each other).

C.5) Examine the whole job site. Keep all people, vehicles, etc. away from the activation location (minimum 30 meters).

C.6) Place enough men at critical locations to stop people and vehicles when there is a need to stop them (for safety) during the activation period.

C.7) Put the on/off key at "on" position. Select the power from power source selection switch; either start the generator or turn on the power source from the city mains. Make a final check for all points (wires, cables, cover, and environment).

C.8) Check the "operation stop/cancel button".

C.9) Select the initial waiting period (IWP), adjust the selected option for activation.

C.10) Press the selected activation buttons (concurrent or with delay). Follow the count down and take the hand held remote countdown (IWP) unit.

C.11) Take the remote Stop/Cancel reel with cable (that is connected to the remote Stop/Cancel socket on the ESU).

C.12) Observe the activation till it ends and wait for an extra 30 seconds to move to the activation area.

D—after the Activation

D.1) Let all covers be removed and placed in a proper place.

D.2) Examine all holes and be sure that all are activated.

D.3) Then start excavation with an excavator with a back-hoe bucket. Pull all broken rock away from the main block.

D.4) After clearing the broken rock, if you think that a rock hammer is necessary, then employ it to sections where there are not hole signs.

D.5) After all activation, always clear the area for the next operation. Never drill and do all operations on the broken rock or debris left from the previous operation.

To summarize, the chemical composition according to the present disclosure is related to an ELECTRONICALLY ACTIVATED CHEMICAL ROCK BREAKING SYSTEM characterized by comprising a. chemical composition in a module set comprising
   - potassium chlorate with ratio of 20-55% by weight of the chemical composition,
   - sodium perborate or Tetra acetyl ethylene diamine (TAED) or any combination of them with ratio of 10-24% by weight of the chemical composition,
   - at least one fruit and/or vegetable powder selected from the group consisting of carob powder, dried grape powder, dried currant powder, dried date powder, dried coconut fruit powder, dried pumpkin powder, dried sugarcane, sugar beet powder, dried tamarind powder and dried fig powder with ratio of 9-28% by weight of the chemical composition,
   - at least one powder selected from the group consisting of olive pulp powder, nut shell powder, coconut shell powder, pumpkin seed shell powder, sunflower seed shell powder with ratio of 5-20% by weight of the chemical composition, b. electronic ignition component inside the module set, directly in contact with the chemical composition, c. Energy Supply Set comprising at least one Energy Supply Unit (ESU).

In one embodiment of the present disclosure, chemical composition comprises dried fruit powders and/or dried vegetable powders such as carob powder, dried grape powder, dried currant powder, dried date powder, dried coconut fruit powder, dried pumpkin powder, dried sugarcane, sugar beet powder, dried tamarind powder, dried fig powder.

In one embodiment of the disclosure, chemical composition comprises shell powders such as the olive pulp powder, nut shell powder and/or coconut shell powder.

In another embodiment of the present disclosure, the sodium perborate in the chemical composition is either monohydrate or tetrahydrate.

In another embodiment of the present disclosure, the olive pulp powder in the chemical composition is grinded dry powder of green and/or black olive pulp.

In another embodiment of the present disclosure, the chemical composition is a dry bulk mixture or dry mixture or mixed with other non-explosive solid or liquid chemicals or with some adhesives/glue or binders.

The chemical composition according to this disclosure is activated by an electronic ignition component by employing its unique energy supply set. The initial target of the disclosure is to break rock in the safest way avoiding the risks and problems faced with the existing products. In connection with such an idea, the basic aims can be given with an expression we have generated, namely "SEPPECS". This expression is derived from the first letters of; Simple, Economic, Powerful, Practical, Efficient, Competitive, Safe.

In order to support the targets and show the proof of the facts, several basic and essential tests have been generated. Below, these tests, results and related comments can be observed on Table 2.

TABLE 2

Basic and essential tests and their outputs

| Definitions | Result and/or Explanations | Comments | Standard testing method if any |
|---|---|---|---|
| A) CHEMICAL and PHYSICAL Properties of Chemical Composition | | | |
| Flammability | Non-flammable at room temperature and higher temperatures | The material is not flammable in open flame for short durations. When ignited by an outside source, it gives an exothermic reaction with a bright light at around 450-500° C. It burns with a fast cracking sound in a very short time. | |
| Self-Igniting property | No self-igniting property | — | |
| Explosivity - BAM Fall hammer (Impact) | No explosive property | The impact energy up to max. level of 50 J was applied and no explosion was observed. Besides, the material was compressed by 5000 psi (320 atm) and no observable change has been recorded. This 50 J level is far more above limiting energy (safe limit) as indicated in related standards. | UN Handbook Test series 3. Type 3(a) STANAG 4489 |
| Explosivity - BAM Friction | No explosive property | Material is tested up to 110N friction load and no explosion or burning was observed. This friction load is above the limiting force to be applied (safe limit) as indicated in related standards. | UN Handbook Test series 3. Type 3(b) |
| Oxidative property | It has no oxidative property in its solid state. It is fairly a strong oxidant in humid and aqueous media for most of the metals. | Because of its ingredients, in humid and aqueous media it oxidizes and rusts the metals (chromium, nickel, copper and iron etc.). | |
| Effect of Electricity | No change was observed by application of city voltage and current. | No change, burning or explosive behavior was observed upon applying 220 volts city potential and 10 ampere current. | |

Also, the chemical composition of the present disclosure is tested according to ADR and UN Handbooks for "International Carriage of Dangerous Goods by Road". The test results are given in Table 3.

TABLE 3

| | | | |
|---|---|---|---|
| C) CLASSIFICATION Tests according to ADR and UN Handbooks | | The tests are done according to the procedures and definitions given in the UN Handbook. Considering the product specifications, the target was to observe whether it falls in Class 5.1 (Sect. 34) as oxidizing substance | UN Handbook-Section 34 |
| Test Method for Oxidizing Substances Test O.1 for oxidizing solids | Tests to observe Division 5.1 and Packing Groups, I-II-III | The tests are done according to the procedures and definitions given in the UN Handbook, Section 34.4 Results proved that, Chemical composition of the present disclosure falls in; Class (Div) 5.1 - Packing Group II or III | UN Handbook Sub Section 34.4 |
| UN Code designation | Search and evaluation of tests According to ADR and UN Handbooks | Considering test results, product specifications, UN Code is given as UN3085 - oxidizing solid, corrosive - n.o.s. | ADR and UN Handbooks (related sections) |
| D) TEST SERIES 2 Tests to observe the insensivity of the CHEMICAL COMPOSITION OF THE PRESENT DISCLOSURE for excluding from Class 1 | Tests according to the UN Handbook - Section 12 | Chemical composition of the present disclosure to be excluded from Class 1, 3 tests given in this section must give negative "–" results | UN Handbook Sect. 12 |
| Test Code/Name 2(a) Gap test 2(b) Koenen test 2(c) Time/pressure test | These 3 tests are the essential ones required to observe a chemical product in or out of Class 1 (as per ADR and/or UN Handbooks) | These 3 basic tests have been carried out according to the specifications and standards given in the related section, using the devices and apparatus manufactured as per the given specs and dimensions. Results of these 3 tests showed negative outputs for "Chemical composition of the present disclosure", which means said chemical composition came out to be a product defined out of Class 1. | |

The invention claimed is:

1. A chemical composition for electronically activated chemical rock breaking system, comprising:

potassium chlorate with ratio of 20-55% by weight of the chemical composition, sodium perborate or Tetra acetyl ethylene diamine (TAED) or any combination of them with ratio of 10-24% by weight of the chemical composition, at least one fruit and/or vegetable powder selected from the group consisting of carob powder, dried grape powder, dried currant powder, dried date powder, dried coconut fruit powder, dried pumpkin powder, dried sugarcane, sugar beet powder, dried tamarind powder and dried fig powder with ratio of 9-28% by weight of the chemical composition, at least one powder selected from the group consisting of olive pulp powder, nut shell powder, coconut shell powder, pumpkin seed shell powder, sunflower seed shell powder with ratio of 5-20% by weight of the chemical composition.

2. A chemical composition for electronically activated chemical rock breaking system according to claim 1, wherein said sodium perborate in the chemical composition is either monohydrate or tetrahydrate.

3. A chemical composition for electronically activated chemical rock breaking system according to claim 1, wherein said olive pulp powder in the chemical composition is grinded dry powder of green and/or black olive pulp.

4. A chemical composition for electronically activated chemical rock breaking system according to claim 1, wherein said chemical composition comprises optionally non-explosive solid or liquid chemicals or some adhesives/glue or binders.

* * * * *